US006003450A

United States Patent [19]

Bruckner et al.

[11] Patent Number: 6,003,450

[45] Date of Patent: Dec. 21, 1999

[54] TABLE LIFT APPARATUS

[75] Inventors: Sanford Bruckner, Bronx, N.Y.; Juan Jose Pardo Herrera, Saragossa, Spain

[73] Assignee: Selby Furniture Hardware Company, Bronx, N.Y.

[21] Appl. No.: 08/402,634

[22] Filed: Mar. 13, 1995

[51] Int. Cl.[6] ..... A47B 1/04

[52] U.S. Cl. ..... 108/76; 108/99; 108/71

[58] Field of Search ..... 108/76, 71, 84, 108/99, 100, 96, 138, 136, 77, 17, 161, 69

[56] References Cited

U.S. PATENT DOCUMENTS

| | | | |
|---|---|---|---|
| 210,031 | 11/1878 | Hawthorn | 108/138 |
| 210,593 | 12/1878 | Briggs | 108/138 |
| 305,005 | 9/1884 | Hutton | 108/138 |
| 2,170,098 | 8/1939 | Stephenson | 108/138 X |
| 4,194,452 | 3/1980 | Crowther et al. | 108/99 X |
| 5,249,533 | 10/1993 | Moore, III | 108/71 X |
| 5,403,082 | 4/1995 | Kramer | 108/69 X |

FOREIGN PATENT DOCUMENTS

| | | | |
|---|---|---|---|
| 642982 | 9/1928 | France | 108/17 |

*Primary Examiner*—Jose V. Chen
*Attorney, Agent, or Firm*—Malina & Wolson

[57] ABSTRACT

A lift apparatus includes a folding frame assembly and a pair of support members which are connected to the folding frame assembly by a linkage. The apparatus is mounted on a coffee table base and is capable of an open position in which the table top of the coffee table is lifted to a height appropriate for a dining table. The support member supports a hinged leaf which increases the size of the table top when in the open position.

18 Claims, 4 Drawing Sheets

TABLE LIFT APPARATUS

BACKGROUND OF THE INVENTION

The present invention relates generally to adjustable tables and more particularly to a table lift apparatus which is capable of a closed position which functions as a coffee table and which is capable of easily moving to an open position which functions as a dining table.

The prior art includes numerous examples of tables which are capable of expanding from a relatively smaller size to a relatively larger size. This expansion in size has, in the past, been accomplished through the use of a variety of supplementary table leaves which are added to the primary table top through the use of a variety of sliding mechanisms. In general, the operation of these tables is awkward, requiring the handling of relatively heavy and bulky leafs. The operation of these tables often requires two persons. In addition, the prior art contains a range of tables which include various types of folding legs. In general, these tables can be folded so that the legs are parallel to the table top thereby forming a storage configuration which requires a minimum of volume.

While the mechanisms for this expansion in size for the various dining tables in the prior art and the application of folding mechanisms for the storage of tables has generally been successful, there has not been a means for converting a table from a relatively smaller, and lower coffee table configuration, to a relatively larger and higher dining table configuration.

OBJECTS AND SUMMARY OF THE INVENTION

It is an object of the present invention to provide a table lift apparatus which is capable of reversibly converting a table from a coffee table configuration to a dining table configuration.

Another object of the present invention is to provide a table lift apparatus which facilitates lifting the table top of a coffee table to a height suitable for dining which maintains the table top in a parallel condition.

Another object of the present invention is to provide a table lift apparatus which facilitates the expansion of the table top of a coffee table to a width suitable for dining.

Another object of the present invention is to provide a table lift apparatus which can easily be operated by one person.

Yet another object of the present invention is to provide a table lift apparatus which is comprised of a relatively small number of relatively simple component parts resulting in a relatively low cost of manufacture.

The foregoing and other objects and advantages of the invention will appear more clearly hereinafter.

In accordance with the present invention, there is provided a table lift apparatus which includes a base, a folding frame assembly which is pivotally mounted on the base and a support member which is connected to the folding frame assembly by a linkage. The base is typically mounted on a coffee table furniture frame which includes legs which have a height which is appropriate for a coffee table. The coffee table frame may be of any style desired as long as the height of the legs are appropriate for a coffee table.

The folding frame is formed of pivotally connected members and is capable of being folded into a relatively flat configuration. When in the flat configuration the support member which is connected to the folding frame by a linkage is also folded flat. A table top of a size appropriate for a coffee table is mounted on the folding frame. The table top is formed of two leaves which are connected by a hinge thereby allowing the table top to be unfolded and thereby doubled in size.

When the frame assembly is folded flat, the table lift apparatus maintains the table top at a height appropriate for a coffee table. When the table top is pulled upward by an operator, the frame assembly unfolds thereby raising the table top to a height appropriate for a dining table. As the frame assembly unfolds the support member is pivoted upwardly by the linkage. The table top can then be unfolded so that one half of the table top rests on the support member. The frame assembly includes a tension spring which aids the operator in unfolding the frame assembly and moving the table lift apparatus into the dining table configuration.

DESCRIPTION OF THE DRAWINGS

Other important objects and advantages of the invention will be apparent from the following detailed description taken in conjunction with the accompanying drawings in which.

DETAILED DESCRIPTION OF THE INVENTION

Figure 1:
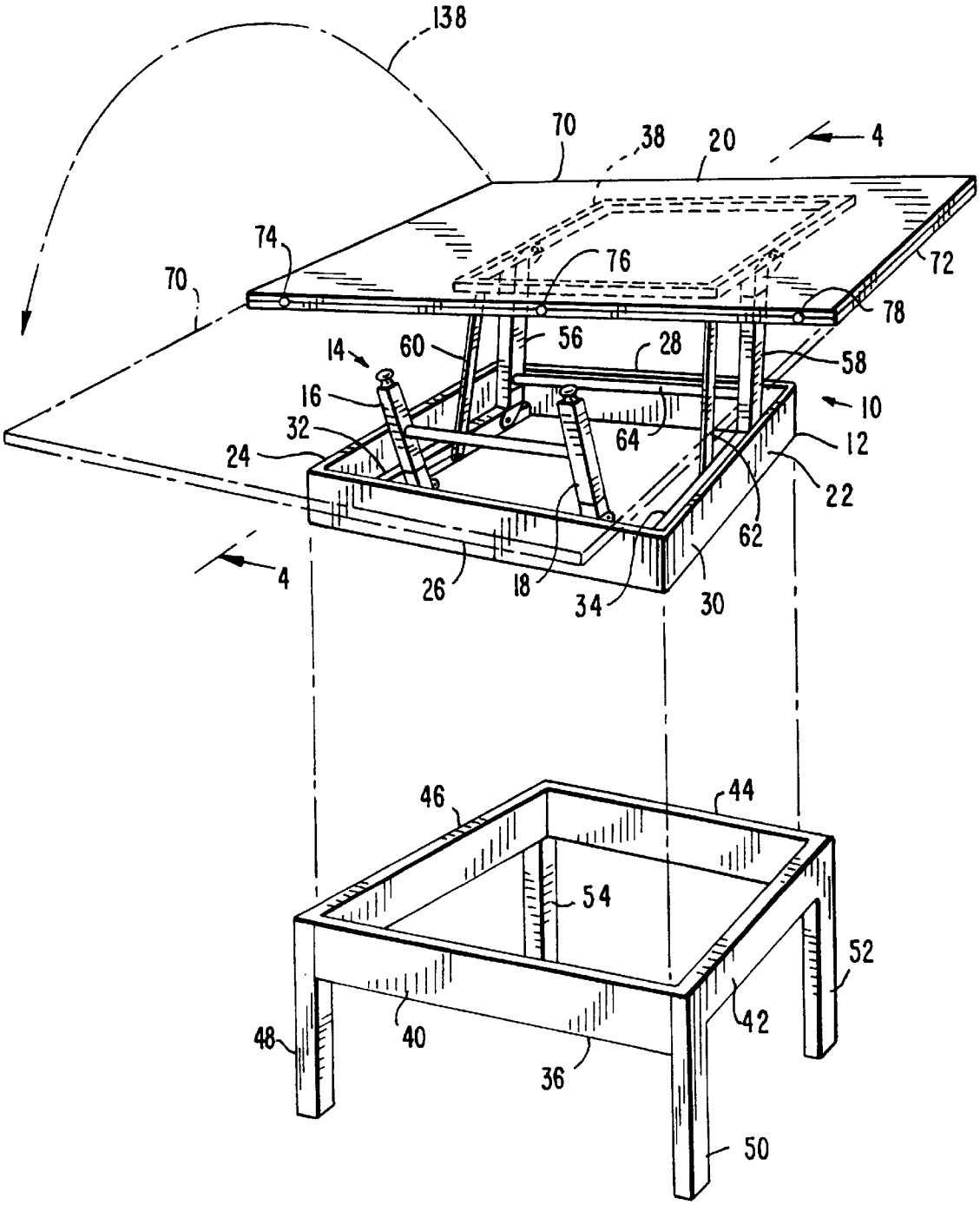
FIG. 1 is an overall exploded perspective view of a table lift apparatus, made in accordance with the present invention with the table lift apparatus shown installed in a table and shown in a partially open, or lifted position.

With reference to the drawings there is shown in FIG. 1 a table lift apparatus 10, made in accordance with the present invention, which includes a base 12, a folding frame assembly 14, a pair of support members 16,18 and a table top 20.

The base 12 includes four elongated members 22,24,26, 28 which form a rectangular frame 30. The base 12 includes a pair of support rails 32,34 which are parallel to the elongated members 22,24 and the frame 30 is mounted on a coffee table support 36. The folding frame assembly 14 is connected to an upper frame 38.

Figure 4:
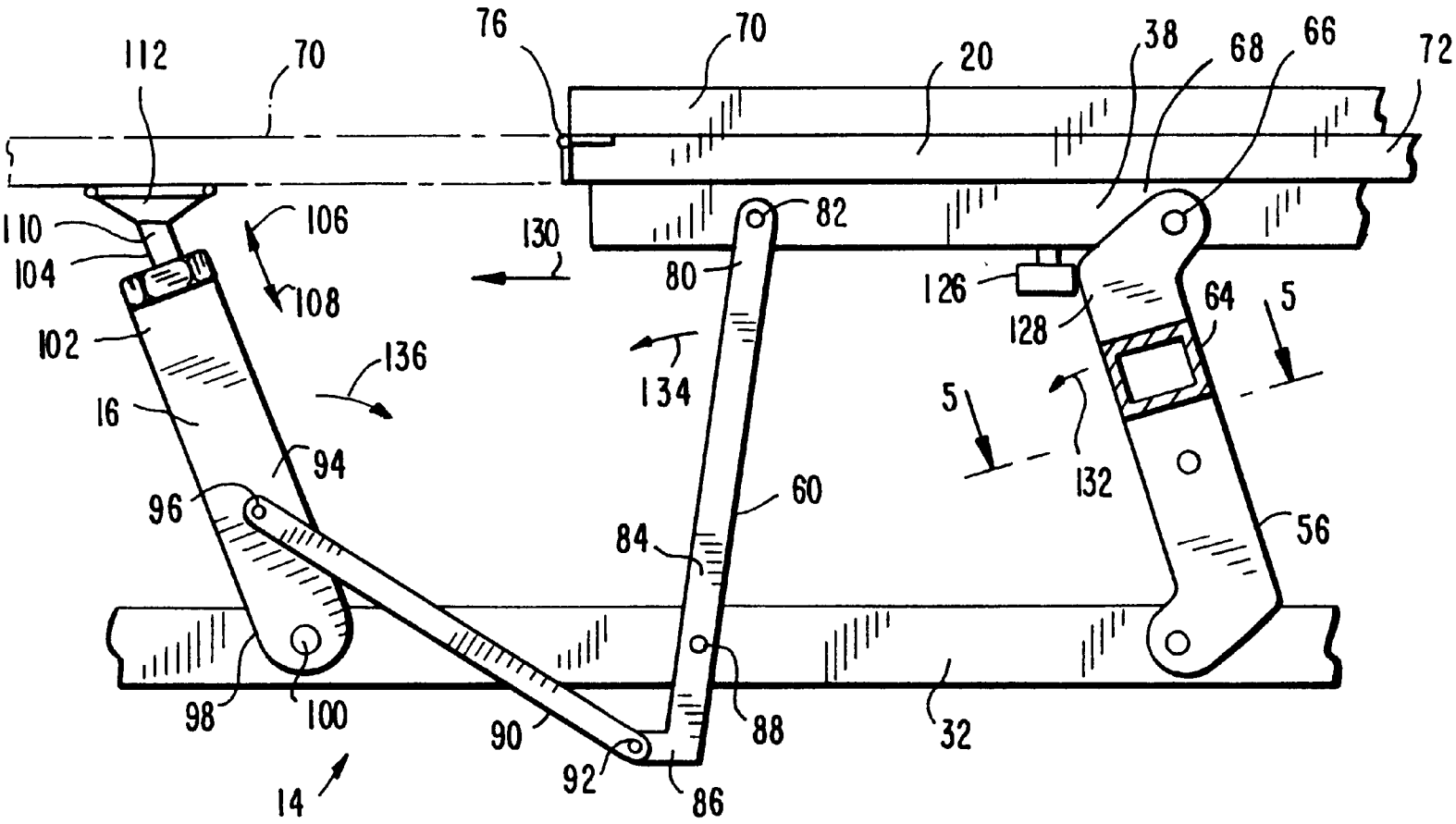
FIG. 4 is cross-sectional view taken along the line 4—4 of FIG. 1.

The folding frame assembly 14 and the support members 16,18 are best shown in FIGS. 1 and 4. The folding frame assembly 14 includes a pair of hollow members 56,58, a pair of link members 60,62 and a cross member 64 which connects the pair of hollow members 56,58. FIG. 4 show the hollow member 56, the link member 60 and the support member 16 in greater detail. It should be understood that the members 16,56,60 shown in FIG. 4 are typical and representative of the members 16,18,56,58,60,62 shown in FIG. 1.

As is shown in FIG. 4, the hollow member 56 has an upper pivot 66 which connects the hollow member 56 to the member 68 which is part of an upper frame 38 and which is connected to the table top 20. The table top 20 includes a pair of leaves 70,72 which are connected by hinges 74,76,78 with the link member 60 having an upper end 80 which is connected to the member 68 by the pivot 82. The link member 60 also has an intermediate portion 84 and a lower end 86. The intermediate portion 84 is connected to rail 32 of the base 12 by the pivot 88. The lower end 86 of the link member 60 is connected to the connecting link 90 by the pivot 92 and the connecting link 90 is connected to the intermediate portion 94 of the support member 16 by the pivot 96. The lower end 98 of the support member 16 is connected to the rail 32 by the pivot 100. The upper end 102 of the support member 16 has an adjustable member 104 which can be adjusted in the directions shown by the arrows 106,108 in FIG. 4 by means of the threaded shaft 110. The threaded shaft 110 has a pivotally mounted pad member 112. The pad member 116 supports the table leaf 70 when the table leaf 70 is unfolded as indicated by the broken line in FIGS. 1 and 4.

Figure 5:
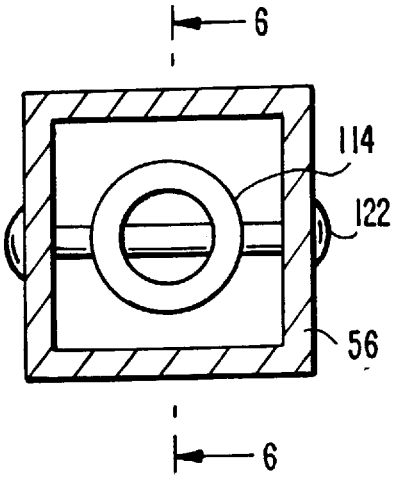
FIG. 5 is a cross-sectional view taken along the line 5—5 of FIG. 4.
Figure 6:
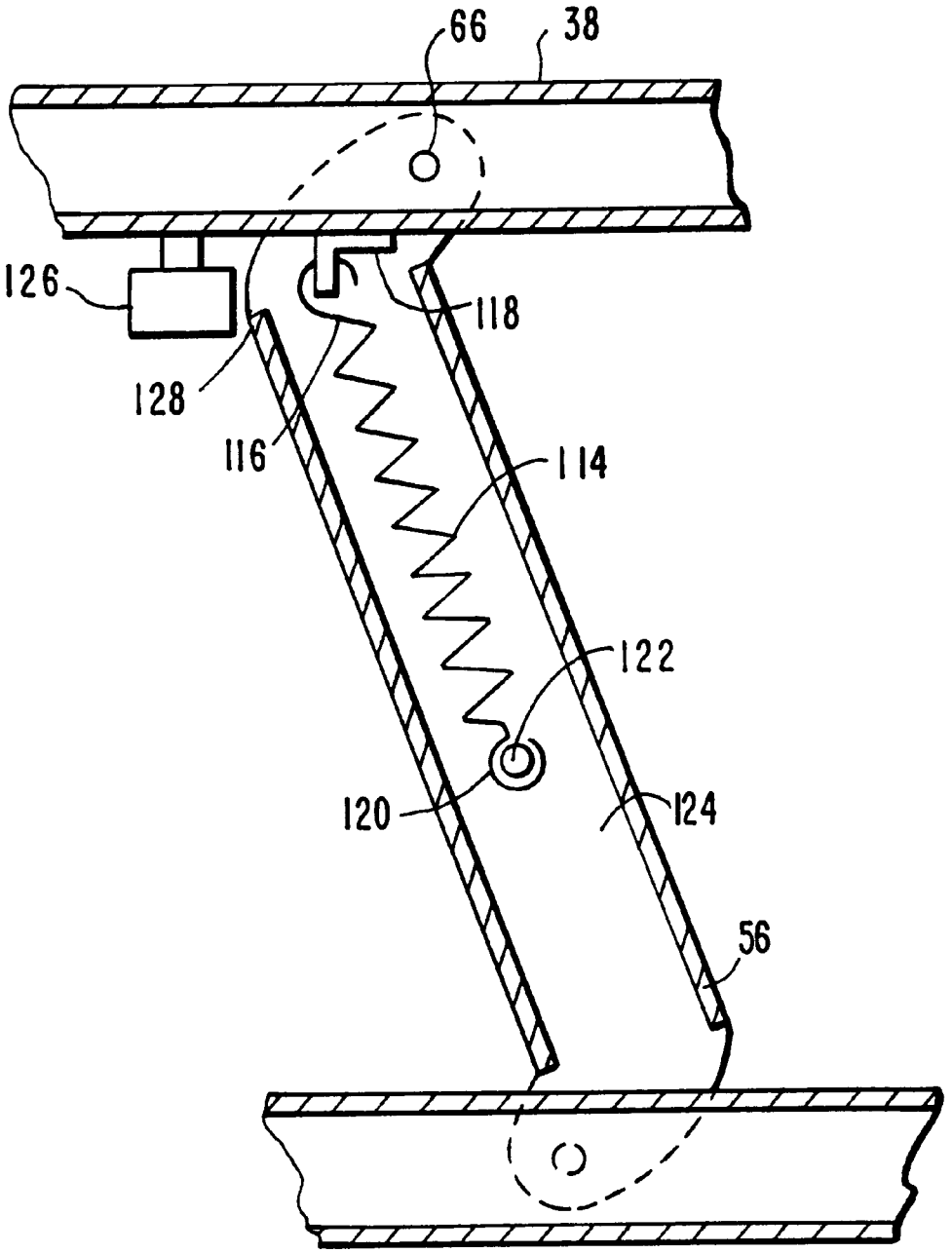
FIG. 6 is a cross-sectional view taken along the line 6—6 of FIG. 5 showing details of internal construction.

As is best shown in FIGS. 5 and 6 the folding frame assembly 14 includes a tension spring 114 the end 116 of which is connected to a bracket 118 which is mounted on the upper frame 38. The tension spring 114 projects into the hollow member 56. The end 120 of the tension spring 114 is connected to the pin 122 which is mounted on the intermediate portion 124 of the hollow member 56.

Figure 3:
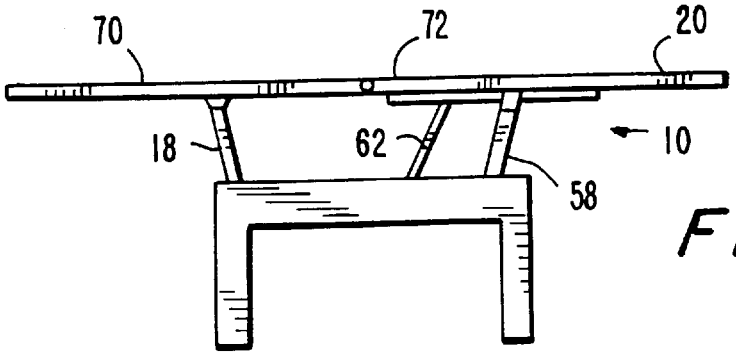
FIG. 3 is a side elevation view similar to FIG. 2 showing the table in an open or lifted position.

FIGS. 3 and 4 shows the folding frame assembly 14 and the support member 16 in the open, unfolded, configuration. In that configuration, the stop member 126 which is mounted on the upper frame 38 bears against the portion 128 of the hollow member 56. The tension spring 114 tends to maintain the table lift apparatus 10 in the open unfolded position.

In the open unfolded position the folding frame assembly 14 and the support members 16,18 support the table top 20 in an upper position, as is shown in FIGS. 3 and 4.

When the table leafs 70,72 are pulled in the direction shown by the arrow 130 in FIG. 4, the hollow member 56 moves in the direction shown by the arrow 132, the link member 60 moves in the direction shown by the arrow 134 while the support member 16 moves in the direction shown by the arrow 136.

Figure 2:
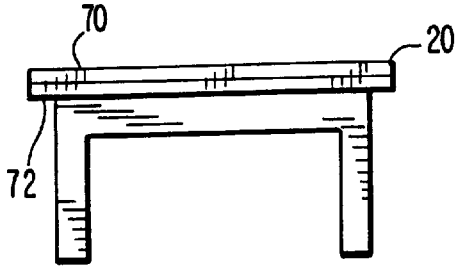
FIG. 2 is a side elevation view of the table of FIG. 1 with the table shown in a closed or lowered position.

When the table lift apparatus 10 is moved into the closed lower position the table top 20 is in the lower position in which position the table top 20 is at a height appropriate to a coffee table as is shown in FIG. 2.

As described in connection with FIG. 6, the helical tension spring 114 urges the folding frame assembly 14 toward the open, unfolded position. The tension spring 114 thus aids in lifting the table top 20 from the position show in FIG. 2, to the position show in FIG. 3 thereby enabling one person to easily convert the table top 20 from the coffee table configuration to the dining table configuration. During the lifting of the table top 20 from the position shown in FIG. 2 to the position shown in FIG. 3 the leaves 70,72 remain generally parallel to the coffee table support 36. The leaf 70 can than be easily rotated into the open position as indicated by the arrow 138 in FIG. 1.

The foregoing specific embodiment of the present invention as set forth in the specification herein is for illustrative purposes only. Various changes and modifications may be made within the spirit and scope of this invention.

What is claimed is:

1. A table lift apparatus comprising a base, lift means, with said lift means mounted on said base, support means pivotally mounted on said base, and with said support means capable of pivoting to a position supporting said table top when said table top has been lifted to said higher level, and said support means comprising an elongated support member, with said elongated support member having an upper end, a lower end and an intermediate portion with said intermediate portion pivotally connected to said base, with said support member capable of a closed position and an open position, connection means, with said connection means connecting said support means and said lift means and with said connection means disposed to pivotally move said support means to said position supporting said table top when said table top is at said higher level, said connection means comprising a link member having a first end and a second end with said first end pivotally connected to said lower end of said support member and with said second end pivotally connected to said folding frame means.

2. A table lift apparatus according to claim 1 in which said lift means comprises folding frame means with said folding frame means pivotally connected to said base and with said folding frame means capable of a folded position and an unfolded position.

3. A table lift apparatus according to claim 2 in which said folding frame means comprising spring means with said spring means biasing said folding frame means toward said unfolded position.

4. A table lift apparatus according to claim 3 in which said spring means comprises tension spring means.

5. A table lift apparatus according to claim 2 further comprising stop means, with said stop means disposed on said table top and with said stop means bearing on said folding frame means when said folding frame means is in said unfolded position.

6. A table lift apparatus according to claim 2 in which said folding frame means includes at least one hollow member.

7. A table lift apparatus according to claim 6 in which said spring means is disposed in said hollow member.

8. A table lift apparatus according to claim 7 in which said spring means connects said hollow member and said upper bar.

9. A table lift apparatus according to claim 2 in which said folding frame means comprises an upper bar.

10. A table lift apparatus according to claim 2 in which said folding frame means comprises a pair of frames.

11. A table lift apparatus according to claim 1 which said table top means comprises a pair of identical leafs.

12. A table lift apparatus according to claim 1 in which said support means comprises a pair of spaced apart elongated support members.

13. A table lift apparatus comprising:

a base, folding frame means with said folding frame means pivotally connected to said base;

an elongated support member, with said support member having an upper end, a lower end and an intermediate portion, with said intermediate portion pivotally connected to said base, with said elongated support member capable of a folded position and an unfolded position, a link member having a first end and a second end, with said first end pivotally connected to said lower end of said support member and with said second end pivotally connected to said folding frame means;

with said folding frame means capable of a closed, folded position and an open unfolded position, and with said link member capable of moving said support member into said folded position when said folding frame means is in said closed folded position and moving said support member into said open unfolded position when said folding frame means is in said open unfolded position;

spring means connected to said folding frame means, with said spring means biasing said folding frame means toward said open unfolded position;

table top means with said table top means mounted on said frame means, with said table top means in a lower position when said folding frame means is in said closed folded position and with said table top means in an upper position when said folding means is in said open unfolded position;

in which said table top fully overlies said base when said table top is at said higher level.

14. A table lift apparatus comprising a base, lift means, with said lift means mounted on said base, a table top, with said table top mounted on said lift means, with said lift means capable of lifting said table top from a lower level, to a higher level, support means pivotally mounted on said base, and with said support means capable of pivoting to a position supporting said table top when said table top has been lifted to said higher level, connection means, with said connection means connecting said support means and said lift means and with said connection means disposed to pivotally move said support means to said position supporting said table top when said table top is at said higher level, capable of lifting said table top from a lower level, to a higher level, said table top means comprising a pair of identical leafs, and hinged connection means connecting said pair of leafs.

15. A table lift apparatus comprising a base, lift means, with said lift means mounted on said base, a table top, with said table top mounted on said lift means, with said lift means capable of lifting said table top from a lower level, to a higher level, support means pivotally mounted on said base, and with said support means capable of pivoting to a position supporting said table top when said table top has been lifted to said higher level, connection means, with said connection means connecting said support means and said lift means and with said connection means disposed to pivotally move said support means to said position supporting said table top when said table top is at said higher level, capable of lifting said table top from a lower level, to a higher level, said table top comprising a first leaf and a second leaf and hinged connection means connecting said first leaf and said second leaf with said first leaf connected to said lift means.

16. A table lift apparatus comprising a base, lift means, with said lift means mounted on said base, a table top, with said table top mounted on said lift means, with said lift means capable of lifting said table top from a lower level, to a higher level, support means pivotally mounted on said base, and with said support means capable of pivoting to a position supporting said table top when said table top has been lifted to said higher level, capable of lifting said table top from a lower level, to a higher level, said table top comprising a first leaf and a second leaf, said support means comprising an elongated support member, with said elongated support member having an upper end, a lower end and an intermediate portion with said intermediate portion pivotally connected to said base, with said support member capable of a closed position and an opened position, said second leaf resting on said upper end of said elongated support member when said elongated support member is in said opened position, and connection means, with said connection means connecting said support means and said lift means and with said connection means disposed to pivotally move said support means to said position supporting said table top when said table top is at said higher level.

17. A table lift apparatus comprising a base, lift means, with said lift means mounted on said base, a table top, with said table top mounted on said lift means, with said lift means capable of lifting said table top from a lower level, to a higher level, support means pivotally mounted on said base, and with said support means capable of pivoting to a position supporting said table top when said table top has been lifted to said higher level, said support means comprising an elongated support member, with said elongated support member having an upper end, a lower end and an intermediate portion with said intermediate portion pivotally connected to said base, with said support member capable of closed position and an open position, said upper end of said elongated support member further comprises length adjustment means, connection means, with said connection means connecting said support means and said lift means and with said connection means disposed to pivotally move said support means to said position supporting said table top when said table top is at said higher level.

18. A table lift apparatus according to claim 17 in which said table top fully overlies said base when said table top is at said higher level.

* * * * *